US005486065A

United States Patent [19]

James

[11] Patent Number: 5,486,065

[45] Date of Patent: Jan. 23, 1996

[54] TRAFFIC SPEED CONTROL UNIT AND ASSEMBLY

[76] Inventor: Richard M. James, 30 Holly Lane, Erdington, Birmingham, England, B24 9JS

[21] Appl. No.: 343,583

[22] PCT Filed: Dec. 1, 1994

[86] PCT No.: PCT/GB93/01113

§ 371 Date: Dec. 1, 1994

§ 102(e) Date: Dec. 1, 1994

[87] PCT Pub. No.: WO93/24707

PCT Pub. Date: Dec. 9, 1993

[30] Foreign Application Priority Data

Jun. 3, 1992 [GB] United Kingdom ..... 9211749

[51] Int. Cl.[6] ..... E01F 9/047

[52] U.S. Cl. ..... 404/15; 49/49

[58] Field of Search ..... 49/49, 131–134; 404/15, 16, 10, 11, 6; 340/936

[56] References Cited

U.S. PATENT DOCUMENTS 2,729,805 1/1956 Struke .
3,389,677 6/1968 Dunne .
3,838,391 9/1974 Mintz .
4,332,503 6/1982 Hurst, Jr. ..... 49/131 X
4,974,991 12/1990 Mandavi ..... 404/11 X

FOREIGN PATENT DOCUMENTS 2647132 11/1990 France .
2914708 10/1980 Germany .
2079356 1/1982 United Kingdom .

*Primary Examiner*—Ramon S. Britts
*Assistant Examiner*—James A. Lisehora
*Attorney, Agent, or Firm*—John W. Bunch

[57] ABSTRACT

A speed controlling unit for maintaining a traffic hump in a raised position for a limited time to discourage vehicles from exceeding a threshold speed. The speed controlling unit includes a first surface (**15*a*,415*a*,515*a*,615*a*) adapted for actuation by a moving vehicle, a second surface (15*b*,415*b*, 515*b*,615*b*) which constitutes the traffic hump, and mechanical control structure (16,26; 416,426; 516,526; 616,626**) for temporarily supporting the second surface in its raised position. An assembly of the speed control units may be arranged side by side across a traffic lane.

13 Claims, 4 Drawing Sheets

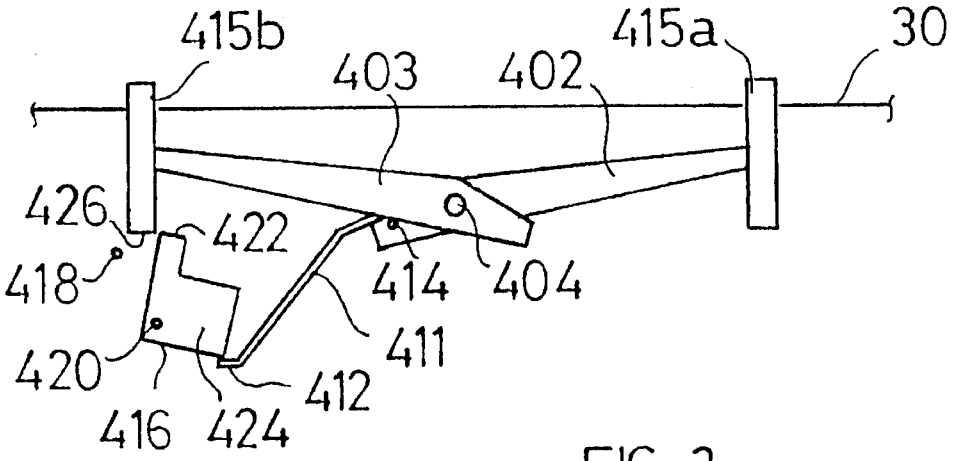
FIG 3
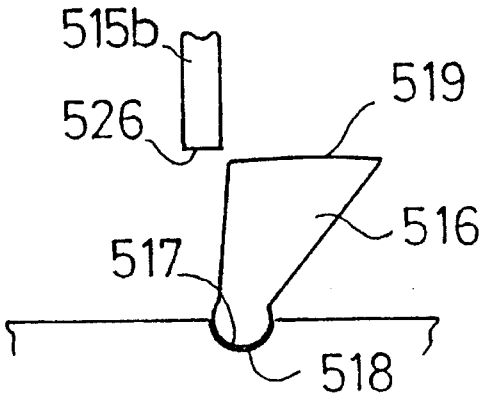
FIG 4
FIG 6
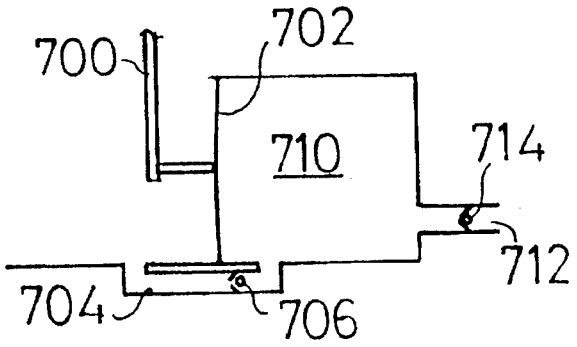

TRAFFIC SPEED CONTROL UNIT AND ASSEMBLY

FIELD OF THE INVENTION

This invention relates to a traffic speed control unit, and assembly.

STATEMENT OF THE PRIOR ART

A number of traffic speed control units, and assemblies, have been proposed, seeking to avoid the need to allocate staff, e.g. policemen, to traffic speed control duties.

One such known unit is a so-called "sleeping policeman" comprising one or more raised portions extending across, usually fully across, the "controlled" road or traffic surface; these raised portions are of sufficient height to cause noticable impacting of a car or other vehicle travelling at more than a minimum speed e.g. 10 kmph. A number of such raised road portions are often used, spaced apart one from another along the road.

One disadvantage of the known arrangement of the traditional "sleeping policeman" is that it is constructed of conventional road-making materials; thus the road or traffic surface needs to be closed to traffic not only whilst the materials are being laid but also until those materials have properly "set".

Another disadvantage of the known arrangement of "sleeping policeman" is the difficulty of preparing it to a predetermined height and dimension in the traffic flow direction; the height will thus vary in accordance with the skill of the person laying the original road surface, and/or the skill of the person laying down the "sleeping policeman" upon an existing road or traffic surface. Drivers meeting a particular "sleeping policeman" for the first time have therefore to assume that it will provide a severe impact, so that those wishing to avoid such an impact need to slow down to a very low traverse speed, no matter what the actual height or extent (in the traffic flow direction) of the "policeman", and this traverse speed may be much lower than necessary, slowing the traffic more than is required. Conversely, because a "sleeping policeman" is so effective at slowing traffic almost to a standstill, it is not suitable for inhibiting traverse traffic speeds only below a "medium value" e.g. 50 kmph, so that "sleeping policemen" are not widely used, if at all, to help reduce to an acceptable value the speed of traffic approaching a dangerous corner, or approaching other potential accident zones such as a hamlet straddling a major road.

DISCLOSURE OF THE INVENTION

We propose a speed control hump suitable for "traffic calming", encouraging a steady traffic flow within defined speed limits. At or below the design speed the drivers should cross the hump without damage to load or vehicle, or loss of control, and they should suffer no discomfort. Above the design speed the driver should suffer discomfort (but still without damage to load or vehicle or risk of loss of control); preferably the degree of discomfort will depend on the amount by which the driver exceeds the design speed up to a preset maximum beyond which the degree of discomfort may remain substantially constant.

In its broadest aspect, we now provide a traffic speed control unit which can be pre-assembled, and installed as a sub-assembly in a road or traffic surface cavity. We also propose an assembly comprising a number of such units, laid side by side across the road. Preferably the traffic speed control unit, and assembly, operate effectively whichever is the direction of traverse.

As a particular feature of our invention, we propose a traffic speed control unit, and assembly, operative to impede traffic flow only above a threshold vehicle speed thereacross. Preferably, the threshold speed can be varied by adjustment of the unit at the discretion of the speed control authority. Furthermore a driver entering a "low speed" area can be alerted by grading the severity of a series of units or assemblies (providing "humps") in conjunction with roadside signs indicating the required traverse speed e.g. from 40 kmph to 15 kmph.

Thus according to one feature of our invention we provide a traffic speed control unit wherein a first support surface and a second support surface are mounted in a housing characterised by mechanical control means adapted to be removably positioned by the first support surface into weight transmitting relation with the second support surface.

SHORT DESCRIPTION OF THE DRAWINGS

FIG. 3 is a partial side elevation of a second embodiment of a traffic speed control unit;

FIG. 4 is a view of an alternative control member for use in a third embodiment of traffic speed control unit;

FIG. 6 is a view of one means for the expulsion of water from a traffic speed control unit.

DESCRIPTION OF THE PREFERRED EMBODIMENTS

Figure 1:
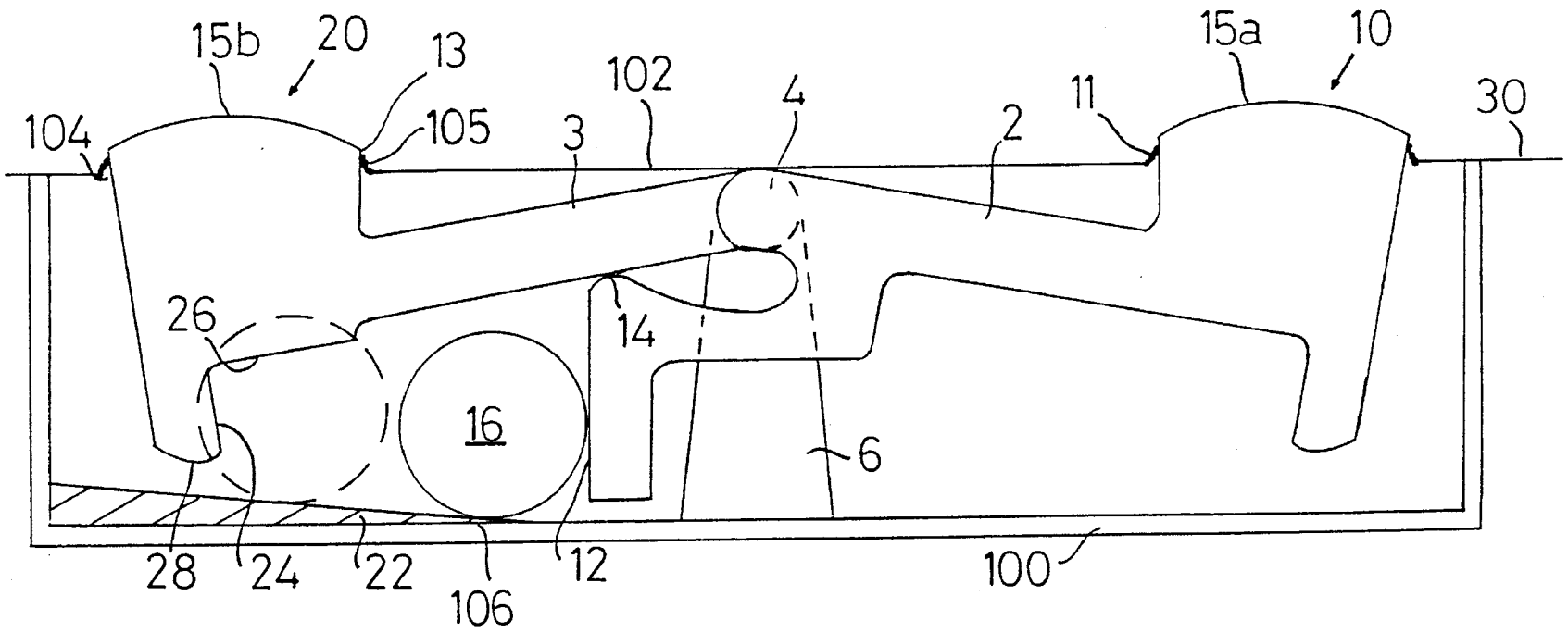
FIG. 1 is a partial side elevation of one embodiment of a traffic speed control unit according to the invention.

The traffic speed control unit of FIG. 1 includes a first "active policeman" member 10 and a second "active policeman" member 20, member 10 being mounted by arm 2, and member 20 being mounted by arm 3, on a common pivot 4 which is supported upon upstand 6. In alternative embodiments the single pivot 4 is replaced by separate co-axial pivots, one for each of the members; and the pivot(s) extends through an aperture in upstand 6, which upstand however then needs to be removed with the members 10,20 for refurbishment of a unit.

Member 10 has an integral control surface 12 engagable by a control roller 16, and an integral drive surface 14 engagable with the arm 3 of the second member 20; in this embodiment the control roller 16 is in the form of a cylinder, whilst in another but less preferred alternative the roller is replaced by a ball. The control roller 16 in its position of use is under compression i.e. it is a compression member.

The members 10,20 are located in a housing 100, sealed in one embodiment by a unitary flexible cover (not shown) to prevent water and dirt ingress. In use the housing can quickly be laid in a pre-cut trench in a road, and secured.

In the embodiment shown, the housing 100 has a rigid e.g. metal, cover 102 with apertures 104 for the wheel support surfaces 15*a*,*b* of the members 10,20, only the apertures then needing to be sealed by the flexible material 11, the material having sufficient resilience to return to its original form (together with member 10 or 20) after passage of a vehicle. We prefer that the first and second active policemen 10,20 be in tight fit with a rubber bush or the like 11 e.g. a corrugated gaiter, at the opening 104 to the road or traffic surface 30, so as to prevent water and dirt ingress into the unit.

The housing 100 will preferably be of a non-corrosive material, but in an alternative but less preferred embodiment could be of thick section, intended to remain intact at least until the assembly is due to be replaced.

Each member 10,20 is adapted so that at any time one or both of the rounded (convex) wheel support surfaces, or "policemen", 15*a,b* project above the road surface 30. Preferably the wheel support surfaces 15*a,b*, at rest, will project an equal distance above the road surface 30, as shown in FIG. 1. In an alternative embodiment, the arms 2,3 are resiliently biassed towards this condition, as by a coil or leaf spring.

As above described, in the normal condition of use, as viewed in FIG. 1, each "policeman" surface 15*a,b* projects upwardly above the road 30, and so into the path of an approaching vehicle. Depression (i.e. downwards in FIG. 1) of first member 10 by a vehicle approaching from the right rotates member 10 clockwise about pivot 4; integral drive surface 14 causes the second member 20 to rotate clockwise, also about pivot 4, allowing control surface 12 to impel control roller 16 up ramp 22, to strike rebound surface 24 on second member 20. The control roller 16 will thus now be in the position shown in dotted outline in FIG. 1, directly beneath (in the FIG. 1 orientation) a load transmitting surface 26 on second member 20.

The period for which control roller 16 remains beneath load transmitting surface 26 will depend upon the angle of the ramp 22, and the coefficient of restitution between the control roller 16 and the rebound surface 24 i.e. how quickly the roller rebounds from the surface 24.

This period, and the spacing (in the direction of vehicle travel) between the first and second members, together determine the threshold speed for the traffic speed control unit i.e. the speed at and above which the unit is operative.

If a vehicle, travelling from right to left, is travelling at below the threshold speed, then the control roller will have rebounded from rebound surface 24, and rolled down ramp 22, before the vehicle wheel loads member 20, so that roller 16 is no longer beneath load transmitting surface 26. The second member 20 can thus be depressed to or below the road level 30, until abutment 28 contacts the bottom 106 of housing 100, whereby the impact felt by the tire will be minimal; in this embodiment ramp 22 is slotted or sectioned to allow movement therepast of abutment 28, but in a less preferred embodiment the abutment 28 can contact the ramp 22 which then acts as the downwards stop for second member 20.

If the vehicle is travelling at greater than the threshold speed set for the unit, then as the vehicle wheel engages the second member 20, the control roller 16 will still be beneath load transmitting surface 26, preventing the second member 20 being depressed, or depressed below the road level, and so surface 15*b*, or more particularly corner 13, of the second member 20 is operative to provide an impact to the wheel, and thus to the vehicle. The magnitude of this impact can be pre-set or pre-determined by the dimensions of the components within the unit, setting the height of corner 13 above road 30 at impact.

Surface 26 is usefully angled such that the greater the vehicle traverse speed above the threshold, the greater the impact by surface 15*b* on the "trailing" arm 3. Alternatively stated, the greater the rebound distance of roller 16 (to the right as viewed in FIG. 1) before it is engaged by surface 26, the lower will be surface 15*b*. In this embodiment therefore, below the threshold speed no or negligible impact will be sustained by the vehicle wheel and felt by the driver, above the threshold speed the impact sustained and feet will increase with increasing vehicle speed until a second vehicle threshold speed is reached and above which a severe but substantially constant impact will be received (with the surface 15*b* held in its "uppermost" protruding condition).

The spacing between the wheel support surfaces 15*a,b* in the direction of travel of a vehicle would preferably be between 15 and 30 cm. This would ensure that wheels on adjacent axles would each operate the traffic speed control unit independently. This spacing should also be greater than the length of the flattened ground-engaging area of the tires of vehicles operating the unit, since if a single tire can span the spacing, then a high impact would be felt independently of the speed of the vehicle.

The traffic speed control unit of FIG. 1 operates only in a single direction i.e. vehicles travelling from the right to the left of the figure.

Figure 2:
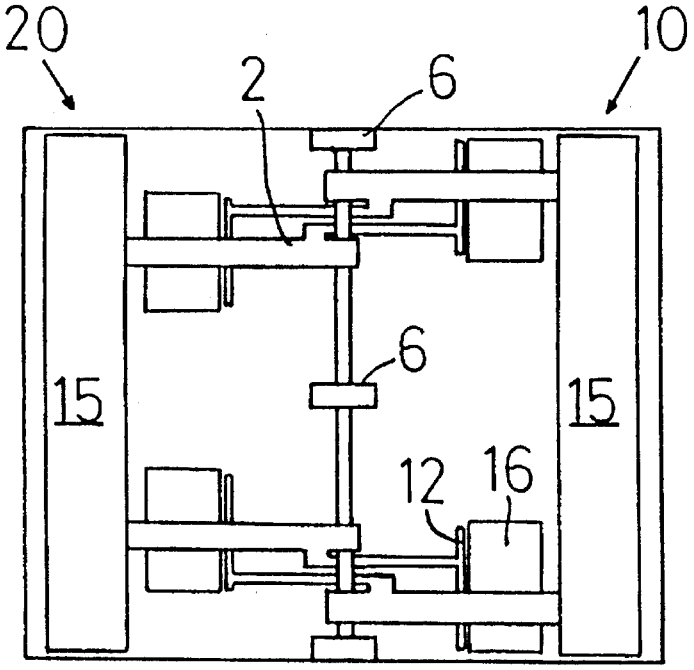
FIG. 2 is a plan view of an composite traffic speed control unit, comprising the units of FIG. 1.

In order to operate in two opposing directions, a composite unit is required. Whilst the simplest form of composite unit would require two wheel-support surfaces each supported on a single arm 2, we prefer the composite unit as shown in FIG. 2, with each wheel support surface supported by two arms 2. In the composite units, the arms 2 are of the same form as the arm 2 of FIG. 1, thus each arm has an integral control surface 12 and drive surface 14, the control surface 12 engaging a control roller 16. Each of the control rollers 16 rests upon a ramp 22 (not shown). Thus, for a vehicle travelling at greater then the threshold speed, whichever of the two members is first contacted by a vehicle wheel, then the other member will provide the impact to the wheel.

In an alternative embodiment, the composite unit of FIG. 2 includes two elongated control rollers, each elongated roller spanning the full width (as viewed in the direction of vehicle-travel) of the unit; in this embodiment the load transmitting surfaces would be supported upon the roller along their+full length when impacting a vehicle travelling at greater than the threshold speed.

Although in one arrangement a single unit could be made of a size to span a road, we prefer that an assembly of smaller units (usefully of 30 cm width) be placed side-by-side, together to extend fully across the road (a) to help prevent vehicles being driven around the unit(s) to avoid the intended traffic speed control, (b) to avoid each of two vehicles, perhaps travelling at different speeds, independently operating a unit in each case, and (c) permitting an assembly of the units to closely follow the camber of the roadway, whilst still permitting uninterrupted traffic flow below the threshold speed.

It is a feature of the invention that not all of the units of an assembly need be pre-set or pre-selected to operate at the same traverse speed threshold; thus units nearer a curb which (temporarily) needs extra protection from fast-moving traffic (for instance if drainage pipes have recently been laid) can be set for a lower threshold than units spaced away from a curb. However the impact felt should be graduated, so that the vehicle is not deflected from its traverse path by too great a possible difference between the impacts felt by the respective front vehicle wheels.

Alternatively units in one traffic lane can permit uninterrupted-traffic flow at a faster traverse speed than in another traffic lane, for instance at car park exits or at traffic census points.

In the embodiment of FIG. 3, the "policeman" surface 415*a*, 415*b* is of shorter length in the vehicle traverse direction (right to left as viewed) than for the FIG. 1 embodiment. One advantage of this is that it may result in smaller angular and vertical displacements of the vehicle suspension (with less likelihood of vehicle damage) whilst retaining a sufficient impulse to cause driver discomfort at traverse speeds above the design threshold. In this embodiment, surfaces 415*a*,415*b* are provided by plates secured respectively to arms 402,403, which move together about pivot 404.

Secured to arm 404 is a kicking lever 411 having a control surface 412 engageable with the control member 416. The control member 416 is movable about pivot 420, such that its upper surface 422 can move into alignment with the load transmitting surface 426 of plate 415*b*. Control member 416 carries a counterweight 424 so that it is gravity biassed to the position shown i.e with the surface 422 out of alignment with the surface 426.

In use, a vehicle approaching from the right will first depress wheel-support surface 415*a*, causing arm 402 to move clockwise about pivot 404; drive surface 414 (which in this embodiment is a surface of a pin projecting from arm 402), engages the undersurface of arm 403, urging the plate 415*b* upwardly (clockwise), to project a greater distance above the road surface 30.

As arm 402 moves, it also carries with it kicking lever 411 with a control surface 412 which impacts control member 416 causing it to move (anti-clockwise as viewed) about pivot 420 whereby the upper surface 422 of member 416 moves to a position below load transmitting surface 426; in a preferred embodiment the movement of the control member 416 is arrested by an abutment 418, from which it can rebound back towards the rest position shown, assisted by the offset gravitational force from counterweight 424, unless held and trapped by the depression of vehicle support member 415*b* with surfaces 426,422 in engagement.

It is an important feature of this embodiment also that the control member (416) can move in response to but detached from control surface 412 of kicking member 411.

If the vehicle is moving at below the threshold speed, then counterweight 424 causes reverse pivotting (in the clockwise direction) of the abutment member 416, so that this is moved out of the path of surface 426 before this has been fully depressed by the vehicle wheel. However, if the vehicle is travelling at above the threshold speed, then the load transmitting surface 426 engages the upper surface 422 of member 416, whereby the wheel support surface 415*b* is held above road 30 and in a wheel-impacting and tire-deflecting condition, with resulting driver discomfort.

There may be more than one arm 402,403 across the unit (as in the composite unit of FIG. 2), or a single arm may support the full width of the wheel support surface 415, 415*b*. The control member 416 may span the whole width of the unit, or only part of the width, as required.

In the alternative embodiment of FIG. 4, the control member 516 has a part-circular lower surface 517 adapted to pivot in part-spherical recess 518 provided in the housing or channel base. The control member 516 is acted on by a kicking lever (not shown) as described in relation to FIG. 4. In the FIG. 5 embodiment the weight of a vehicle on wheel support 515*b* is taken from the load transmitting surface 526 to the upper surface 519 of the control member 516, and thence to the housing or channel base.

In the embodiment shown in FIG. 4, surface 519 is of greater radius at its right hand end (as viewed) than at its left hand end, whereby to provide a vehicle wheel impact proportional to the vehicle speed above the threshold. Thus, the smaller the vehicle speed increment above the design threshold, the greater will be the permitted return movement of the control member 516 before being trapped by surface 526 (when the vehicle engages the wheel support 515*b*), and consequently the further may wheel support 515*b* be downwardly deflected towards the road surface 30, with less driver discomfort therefore than with a higher increment.

In an alternative but less preferred embodiment, return movement of the members 416,516 is spring assisted, in addition to the offset gravitational force.

Figure 5:
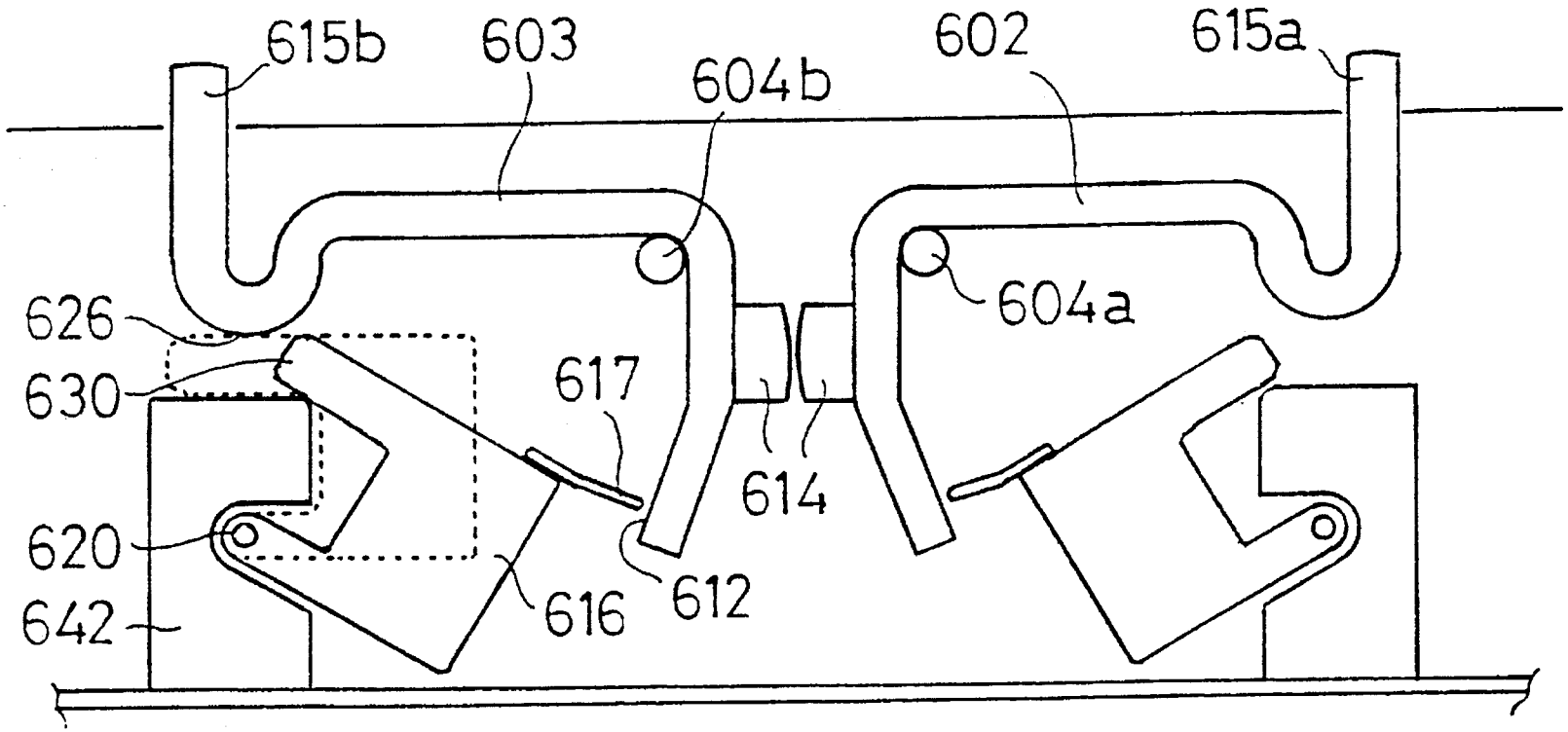
FIG. 5 is a partial side elevation of a fourth embodiment of a traffic speed control unit according to the invention.

In the embodiment of FIG. 5, the arms 602,603 are independently mounted upon respective pivots 604*a*,604*b*. Each arm has a drive surface in the form of a lifting pad 614; the pads are closely spaced, so that rotation of one arm causes corresponding rotation of the other arm. Each arm 602,603 also has a control surface 612 engageable with the respective control member 616. The control members 616 are each movable about pivots 620.

In use, clockwise pivotting as viewed of arm 602 causes contact between the lifting pads 614, causing corresponding clockwise rotation of arm 603. An advantage of this arrangement is that the ratio of the movements of arms 602,603 need not be unity.

The lever 612 of arm 603 contacts an arm 617 of control member 616, "kicking" the control member to the position shown in dotted outline, with a portion 630 of the control member between the load transmitting surface 626 and the anvil 642, in place to prevent downwards movement of wheel support surface 615*b*. In an alternative embodiment, the control member 516 and anvil 642 combination can be replaced by the pivotted member 516 and part-circular bearing of FIG. 4.

It will be understood that by altering the relative positions of the pivots 604*a*,604*b* and of the lifting pads 614, the degree of movement of the second arm 603 relative to the degree of movement of the first arm 602 can be varied, i.e. the unit can be "geared" to provide a larger rotation of the arm 603 than 602, or vice versa, so that the unit can provide a different recorded impact to vehicles travelling at the same above-threshold speed but traversing the unit from different directions.

It will also be understood that whilst the unit of FIG. 3 as shown is operative in only a single vehicle traverse direction, a corresponding kicking lever and abutment could operate upon wheel support surface 415*a* so that the unit becomes bi-directional. Similarly, the unit of FIG. 5 could be adapted to be uni-directional only.

FIG. 6 shows an embodiment of automatic pump to expel water which inadvertently may enter the unit. Attached to one of the arms e.g. arm 402, there is an arm 700 connected to the centre of flexible diaphragm 702. In use, movement of arm 700 will act to move the centre of the diaphragm respectively to the left or right as viewed.

If therefore, despite all the above mentioned precautions, water enters the housing, it will enter the pump through pipe 704, past non-return valve 706 into chamber 710. Movement of the centre of diaphragm 702 to the right as viewed compresses the fluid in the chamber, expelling water through the pipe 712, past non-return valve 714, back to the road surface or drain as required. Movement of the centre of diaphragm 702 to the left caused further water (if any) to be drawn into the chamber. Thus in use, water can be steadily ejected in a series of pulses i.e. upon each occasion arm 402 is engaged by a vehicle wheel. In an alternative embodiment, the pump is provided by a hollow elastomeric body, the entrance to which can first be closed in consequence of movement of arm 402, with further movement of arm 402 resulting in compression of the body and the expulsion of entrained water or other liquids.

It may be desirable, where the minimum of traffic disruption is required, that the traffic speed control units as described in the drawings be located within an outer housing which is itself placed within a trench dug across the road; complete units can then be selectively removed from the trench and replaced, for maintenance.

Typically, the front face of the wheel support surfaces, as seen by approaching vehicles, carries a reflective strip or equivalent, so that the vehicle drivers are made aware of the presence of the units, particularly in dark conditions when roadside warnings may not be seen.

Thus, we have disclosed a unit and assembly which can be left in position in a road for "traffic calming" i.e. to provide substantially uninterrupted flow to vehicles travelling below the threshold speed but which is effective as a "policeman" at speeds above this threshold level. The threshold can be varied to suit particular applications e.g it can be higher when used to help restrict the speed of vehicles entering villages and hamlets, and lower when used to control the exit from car parks and the like. We thus foresee a widespread use for our invention to help control the speed of vehicles at locations where this is not now practical without human supervision, including outside school gates and on blind corners.

Not only have we disclosed a traffic speed control unit which includes a support surface 15 adapted to receive the weight of a vehicle wheel together with means to control the rate of displacement of the support surface when engaged by the wheel, but also we have disclosed a traffic speed control assembly wherein a plurality of such units are laid side by side across a traffic lane (usefully in a common trench), with the support surface above the traffic lane to be impacted by an oncoming vehicle wheel, but adapted to displace to avoid impeding the wheel with driver discomfort if the traverse speed is below a pre-set threshold.

I claim:

1. A traffic speed control unit for providing a jolt to wheeled vehicles travelling faster than a predetermined threshold said, comprising:

a first support surface and a second support surface mounted in a housing, said first support surface being positioned so as to be moved by contact with the wheeled vehicles and said second support surface being positionable in an abutment position proud of said housing for disrupting smooth travel of the wheeled vehicles; and mechanical control means adapted to be removably positioned by the first support surface into weight transmitting relation with the second support surface long enough to provide a jolt to wheeled vehicles travelling faster than said threshold speed, but not long enough to provide a jolt to vehicles travelling slower than said threshold speed.

2. A traffic speed control unit according to claim 1 including mechanical drive means connected with the first support surface, the drive means being adapted to move the second support surface in a direction opposed to, and by a different distance to, that of the first support surface.

3. A traffic speed control unit according to claim 1 including a cover for the housing.

4. A traffic speed control unit according to claim 1 including pivot means for the second support surface, said second support surface being mounted to pivot on said pivot means alternately between the abutment position and a non-abutment position.

5. A traffic speed control unit as claimed in claim 1 wherein the second support surface is coupled to a pivotted arm, and the mechanical control means comprises a load transmitting surface and a rollable weight transmitting member, and the housing includes a ramp, the rollable weight transmitting member being arranged to be impelled along the ramp into weight transmitting relation with the said second support surface.

6. A traffic speed control unit according to claim 1 wherein the mechanical control means comprises a load transmitting surface and a pivotted weight transmitting member, said pivotted weight transmitting member being pivotable into and out of weight transmitting relation with the said second support surface.

7. A traffic speed control unit according to claim 1 including a pair of pivotted arms, one of the arms being connected to a part of the mechanical control means comprising a load transmitting surface engageable with another part of the mechanical control means comprising a weight transmitting member, by said one of the arms having a drive surface engagable with the other of the arms to pivot said other of the arms, by said one of the arms having a control surface engagable with the weight transmitting member when said weight transmitting member is not engaged by the said load transmitting surface, and by said weight transmitting member being one of a rollable member and a pivotable member.

8. A traffic speed control unit as claimed in claim 7 in which the housing has a cover, and a rollable member is mounted to roll upon an inclined surface into said weight transmitting relation with the second support surface, the rollable member being closer to the said cover when in said relation with the load transmitting surface than when engaged with the control surface.

9. A traffic speed control unit as claimed in claim 1 comprising further mechanical control means adapted to be removably positioned by the second support surface into weight transmitting relation with the first support surface whereby the unit can operate for opposite directions of traverse of the unit.

10. A traffic speed control assembly comprising a plurality of traffic speed control units according to claim 1, arranged side by side across a traffic lane, with the support surfaces normally above the traffic lane.

11. A traffic speed control unit according to claim 1 wherein the said mechanical control means is moved from said weight transmitting relation with the second support surface under its weight, the amount of said movement controlling the permitted degree of displacement of the second support surface.

12. A traffic speed control unit for mounting in a housing recessed in a traffic surface to provide a jolt to a wheel of a vehicle travelling on the traffic surface faster than a predetermined threshold speed, comprising:

a first support surface and a second support surface mounted in the housing, said first support surface being positioned so as to be moved by contact with the wheel of the vehicle and said second support surface being positionable in an abutment position proud of the road surface for disrupting smooth travel of the wheel of the vehicle; and mechanical control means adapted to be removably positioned by said first support surface into weight transmitting relation with said second support surface long enough to provide a jolt to a wheel of a vehicle travelling faster than the threshold speed, but not long enough to provide a jolt to a wheel of a vehicle travelling slower than the threshold speed.

13. A traffic speed control unit for providing a jolt to a wheel of a vehicle travelling on a traffic surface faster than a predetermined threshold speed, comprising:

a housing recessed in the traffic surface;

a first support surface and a second support surface pivotally mounted in said housing, said first support surface being positioned so as to be moved by contact with the wheel of a vehicle and said second support surface being positionable in an abutment position proud of said housing for disrupting smooth travel of the wheel of the vehicle; and mechanical control means adapted to be removably positioned by said first support surface into weight transmitting relation with said second support surface long enough to provide a jolt to a wheel of a vehicle travelling at more than the threshold speed, but not long enough to provide a jolt to a wheel of a vehicle travelling at less than the threshold speed.

* * * * *